US007997433B2

(12) United States Patent
Birkigt et al.

(10) Patent No.: US 7,997,433 B2
(45) Date of Patent: Aug. 16, 2011

(54) DEVICE FOR SUSPENDING A TRAVEL RAIL OF AN OVERHEAD CONVEYOR OR A HOISTING MACHINE

(75) Inventors: Reinhard Birkigt, Herdecke (DE); Michael Buike, Hagen (DE); Klaus Enners, Wuppertal (DE); Stefan Fitzler, Iserlohn (DE); Udo Gersemsky, Herdecke (DE); Ingo Grassmann, Herdecke (DE); Sven Müller, Breckerfeld (DE); Klaus Nerger, Neukirchen-Vluyn (DE); Stefan Steinberg, Selm (DE); Rüdiger Ostholt, Wetter (DE)

(73) Assignee: Demag Cranes & Components GmbH, Wetter (DE)

( * ) Notice: Subject to any disclaimer, the term of this patent is extended or adjusted under 35 U.S.C. 154(b) by 851 days.

(21) Appl. No.: 11/537,186

(22) Filed: Sep. 29, 2006

(65) Prior Publication Data

US 2007/0186800 A1 Aug. 16, 2007

(30) Foreign Application Priority Data

Oct. 1, 2005 (DE) ..... 10 2005 047 206

(51) Int. Cl.
*B66C 17/00* (2006.01)

(52) U.S. Cl. ..... 212/315; 212/71; 248/317; 248/323; 248/324; 104/111; 105/148; 81/325

(58) Field of Classification Search ..... 248/317, 248/324, 340, 229.13, 229.23, 228.4, 231.51, 248/338, 336, 346, 300, 301, 302, 230.1, 248/230.5, 316.2, 316.5, 230.4, 231.5, 313, 248/230.2; 104/111, 93; 105/148; 212/315, 212/312; 81/333, 334, 325, 326, 324, 318, 81/157, 327, 415, 335; 269/90; 24/338, 24/336, 346, 300, 301, 302, 517, 521
See application file for complete search history.

(56) References Cited

U.S. PATENT DOCUMENTS 1,660,927 A * 2/1928 Larsen ..... 24/600.2
(Continued)

FOREIGN PATENT DOCUMENTS

DE A 1 096 288 12/1960
(Continued)

OTHER PUBLICATIONS

Interview Summary dated Apr. 8, 2010 for U.S. Appl. No. 12/088,366, filed Mar. 27, 2008, entitled Device for Suspending a Rail, Particularly a Running of an Overhead Conveyor or of a Lifting Apparatus.

(Continued)

*Primary Examiner* — Kimberly Wood
(74) *Attorney, Agent, or Firm* — Gardner, Linn, Burkhart & Flory, LLP

(57) ABSTRACT

A device for suspending a rail of an overhead conveyor or a hoisting machine from a traversing gear or supporting structure includes a tension element, which carries the rail by one end via a fixing device. The fixing device grasps a support element of the rail. The support element widens and extends at least partly in the lengthwise direction of the rail. To provide a device for suspending a rail that provides enhanced safety against collapse, the fixing device includes two fixing parts, which are connected like pliers by means of a bolt running in the lengthwise direction of the rail. The fixing parts swivel toward each other from the open position into the fixing position by their fixing regions. The support element of the rail rests against the bearing surfaces of the fixing parts, even in the open position, when the fastening means are released.

14 Claims, 2 Drawing Sheets

U.S. PATENT DOCUMENTS

| | | | | | |
|---|---|---|---|---|---|
| 2,156,827 | A | * | 5/1939 | Wehr | 104/111 |
| 2,421,447 | A | * | 6/1947 | Watkins | 248/343 |
| 3,596,864 | A | * | 8/1971 | Stephens | 248/227.4 |
| 3,940,173 | A | * | 2/1976 | Ulbing | 294/82.21 |
| 4,116,134 | A | * | 9/1978 | Troth | 104/111 |
| 4,309,052 | A | * | 1/1982 | Drayton | 294/82.2 |
| 5,292,163 | A | * | 3/1994 | Matsuyama | 294/82.33 |
| 5,598,785 | A | * | 2/1997 | Zaguroli, Jr. | 104/111 |
| 5,957,057 | A | * | 9/1999 | Nakamura et al. | 104/111 |
| 6,058,849 | A | * | 5/2000 | Ostholt et al. | 104/93 |
| 6,138,574 | A | * | 10/2000 | Zaguroli, Jr. | 104/106 |
| 6,196,133 | B1 | * | 3/2001 | Fitzler et al. | 105/148 |
| 7,503,263 | B2 | * | 3/2009 | Birkigt et al. | 104/111 |
| 2004/0238473 | A1 | * | 12/2004 | McKay | 212/315 |
| 2008/0230503 | A1 | | 9/2008 | Birkigt | |

FOREIGN PATENT DOCUMENTS

| | | | |
|---|---|---|---|
| DE | 197 53 169 | A1 | 6/1999 |
| EP | 0 860 394 | A2 | 2/1998 |

OTHER PUBLICATIONS

Response filed by Applicant on Apr. 9, 2010 for U.S. Appl. No. 12/088,366, filed Mar. 27, 2008, entitled Device for Suspending a Rail, Particularly a Running Rail of an Overhead Conveyor or of a Lifting Apparatus.

Notice of Allowance and Fee(s) Due dated Jun. 28, 2010 for U.S. Appl. No. 12/088,366, filed Mar. 27, 2008, entitled Device for Suspending a Rail, Particularly a Running Rail of an Overhead Conveyor or of a Lifting Apparatus.

Office Action/Restriction, dated Jul. 15, 2009, for U.S. Appl. No. 12/088,366, filed Mar. 27, 2008.

Office Action, dated Feb. 17, 2010, for U.S. Appl. No. 12/088,366, filed Mar. 27, 2008.

Species Election and Amendment, dated Aug. 13, 2009, for U.S. Appl. No. 12/088,366, filed Mar. 27, 2008.

Response to Notice of Non-Compliant Amendment, dated Dec. 15, 2009, for U.S. Appl. No. 12/088,366, filed Mar. 27, 2008.

* cited by examiner

DEVICE FOR SUSPENDING A TRAVEL RAIL OF AN OVERHEAD CONVEYOR OR A HOISTING MACHINE

The invention pertains to a device for suspending a rail, and particularly to a device for suspending a travel rail of an overhead conveyor or a hoisting machine.

BACKGROUND OF THE INVENTION

From the prospectus (March 2000 edition) entitled "Crane Construction Kit KBK classic and KBK ergo" of the firm Demag Cranes & Components GmbH, Wetter, Germany, there is known a crane construction kit system with C-shaped and I-shaped rails which are open at the bottom, by which one can implement different kinds of constructions, such as monorail telphers, single and double-beam overhead cranes. In each case, the rails are suspended from support structures, other rails, or traversing gears which run into other rails. These suspension systems consist essentially of a rod-like tension element, suspended from the aforesaid support structures, other rails or traversing gears, having at the lower end a steel ball head, which engages with a mating ball cup with plastic slide shells. The ball cup is fastened by a fixing device to the rail being suspended. This ball and socket bearing of the suspension system ensures that the rails align themselves and thus come into a state of equilibrium, i.e., no significant bending load occurs in the tension element.

In a suspension system of C-shaped rails open at the bottom, with a web broadening out toward the top and arranged at the top side of the rail, preferably a Y-shaped or T-shaped web, the fixing device includes two identical fixing parts. These fixing parts are formed as sheet metal parts such that, after being fitted together and held by screws, the broadening web of the rail is clamped in the lower region and the ball cup is accommodated in the upper region, while the tension element is passed through an opening.

This type of suspension system has been popular for many years and may be easily installed on any given portion of a rail, since the fixing parts are fitted together and tightened together by the screws to clamp against the rail.

Also known from the firm of Demag Cranes & Components GmbH, Wetter, Germany, is another suspension system for a C-shaped crane rail open at the bottom, with a web arranged on the top side of the rail and opening upward in a Y-shape. This suspension includes a tension element and a single-piece fixing device. The tension element has a tension rod and a lug, which is secured by its bore to a bolt, which runs in the lengthwise direction of the rail and is mounted in the fixing device. Thus, the tension element can swivel transversely to the rail. The tension element is rigid in and against the lengthwise direction of the rail. The staple-shaped fixing device can be shoved onto the web of the rail from one end and can be fastened by a screw at the desired suspension point on the rail. The screw is led through a bore in the web.

European patent application EP 0 860 394 A2 describes the fastening of a tension element with a ball head in a mating ball cup by a fixing device on a Y-shaped web of a rail. The fixing device may be one-piece. The ball head of the tension element is led from above through the appropriately dimensioned opening of the fixing device and then the two-piece ball cup will likewise be introduced through this opening from the side. Whether the fixing device is secured by further means to the Y-shaped web of the rail is not specified.

German patent application DE-A 51 096 288 shows a fixing device for suspending a rail from an I-shaped beam. This C-shaped fixing device, open on top, has two opposite and swiveling gripping arms which, after the fixing device is arranged underneath the web of the rail, are swiveled by their hook-like ends into a fixing position on the top side of the web. The gripping arms are each fixed by a screw in the fixing position. In particular, this type of fixing is distinguished by the ability to adjust the fixing system with regard to the I-shaped rail. Even in the fixing position of the gripping arms there is sufficient lateral play to adjust the screws and move the fixing device itself sideways in relation to the rail. This document does not take up the subject of preventing a collapse in connection with a failure of the screws.

Moreover, there is known from German patent DE 197 53 169 C2 a device for suspending a rail, especially a hollow rail open at the bottom, for an overhead crane. Here, the rail is also characterized by a Y-shaped web arranged on top, being enclosed by a C-shaped fixing device, which is suspended via a ball head and a tension element from an I-shaped rail. The fixing device between the ball head and the Y-shaped web is in two pieces and is joined together by two screws extending transversely to the rail and arranged one behind the other, looking in the lengthwise direction of the rail. Thus, the ball head is grasped by the two parts of the fixing device. A failure of the screws would result in a loosening of the fixing parts, thus releasing the ball head of the tension element.

SUMMARY OF THE INVENTION

The embodiments of the present invention provide a device for suspending a rail, such as a travel rail of an overhead conveyor or hoisting machine, which provides for enhanced safety against collapse.

According to the invention, a device for suspending a rail, such as a travel rail of an overhead conveyor or hoisting machine, from a traversing gear or supporting structure includes a tension element, which carries the rail by one end via a fixing device. The fixing device grasps a support element of the rail. The support element widens and extends at least partly in the lengthwise direction of the rail. Enhanced safety against collapse is achieved in that the fixing device includes two fixing parts, which are connected by means of a bolt running in the lengthwise direction of the rail. The fixing regions of the fixing parts swivel toward each other from an open position into a fixing position, and the support element of the rail rests against the bearing surfaces of the fixing parts, even in the open position, and when a fastening means connecting the fixing parts is released. As compared to the prior art, the fastening means serves only to secure the fixing device in the lengthwise direction of the rail. The fixing device, which is in the form of gripping arms, is secured to the support element of the rail because of its construction, without the fastening means, and not because of the otherwise customary clamping screws that hold together fixing parts of a fixing device. A bearing surface is arranged on a first fixing part and a mating surface is arranged on a second fixing part. This configuration restricts a further opening of the fixing parts when the fixing device is in the open position. In order to distribute the limiting forces more evenly over the fixing device, one bearing surface and one mating surface are arranged on each of the fixing parts.

Because of the frictional connection of the screws to the web, the fixing device is prevented from sliding along the rail, without weakening the web.

In another embodiment, the fixing device, in an open position, can be shoved onto the support element only in the lengthwise direction of the rail. Thus, the fixing device is not simply put together from two pieces at the site of the desired fastening, as is the case with the prior art. This ensures that the fixing device will not open and the rail will not be dropped if the otherwise customary clamping screws fail.

Optionally, the support element of the rail is configured as a Y-shaped or a T-shaped web running in the lengthwise direction of the rail and arranged on top of the rail. The web should be especially well grasped by the fixing device.

In order to hold the support element of the rail in the fixing device without danger of dropping, a lengthwise opening is arranged in the lengthwise direction of the rail, which narrows to a gap region in the direction of the rail being suspended, which region is narrower than a widening region of the support element of the rail, and in which the support element is held.

In order to carry the rail safely, the fixing device has bearing surfaces in the region of the lengthwise opening, on which the support element rests.

In another embodiment, the fixing device comprises two fixing parts, which are connected in the manner of pliers by means of a bolt running in the lengthwise direction of the rail and which can swivel toward each other from the open position into the fixing position by their fixing regions. The fixing parts are held in the fixing position by fastening means in the form of screws. In the fixing position, the fixing regions of the fixing parts are pretensioned against the sides of the support element, in the lengthwise direction of the rail.

The fabrication of the fixing device is facilitated in that the fixing parts are identical.

The area of application of the suspension system is enlarged in that the fixing device is joined to the tension element.

These and other objects, advantages, purposes and features of the present invention will become apparent upon review of the following specification in conjunction with the drawings.

DESCRIPTION OF THE PREFERRED EMBODIMENTS

Figure 1:
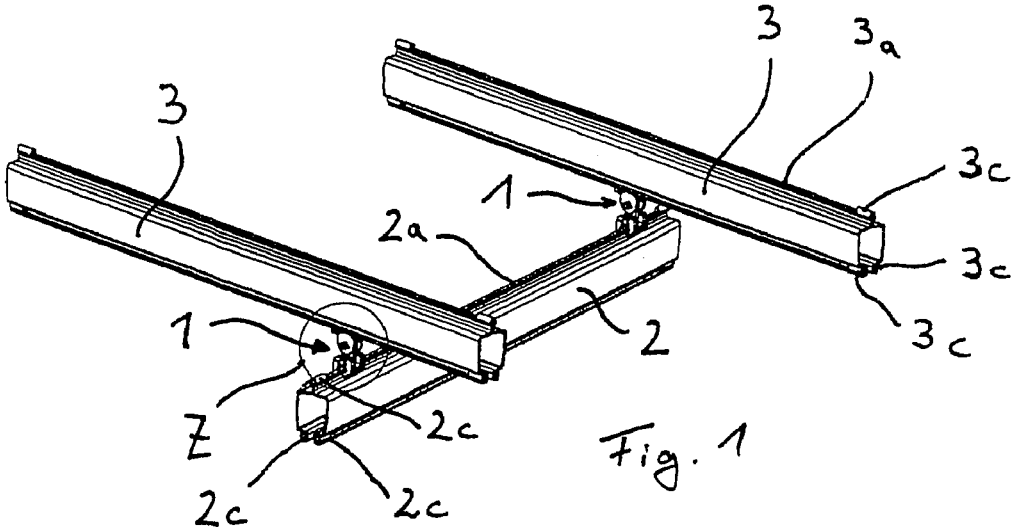
FIG. 1 is a perspective view of a single-beam overhead crane.
Figure 2:
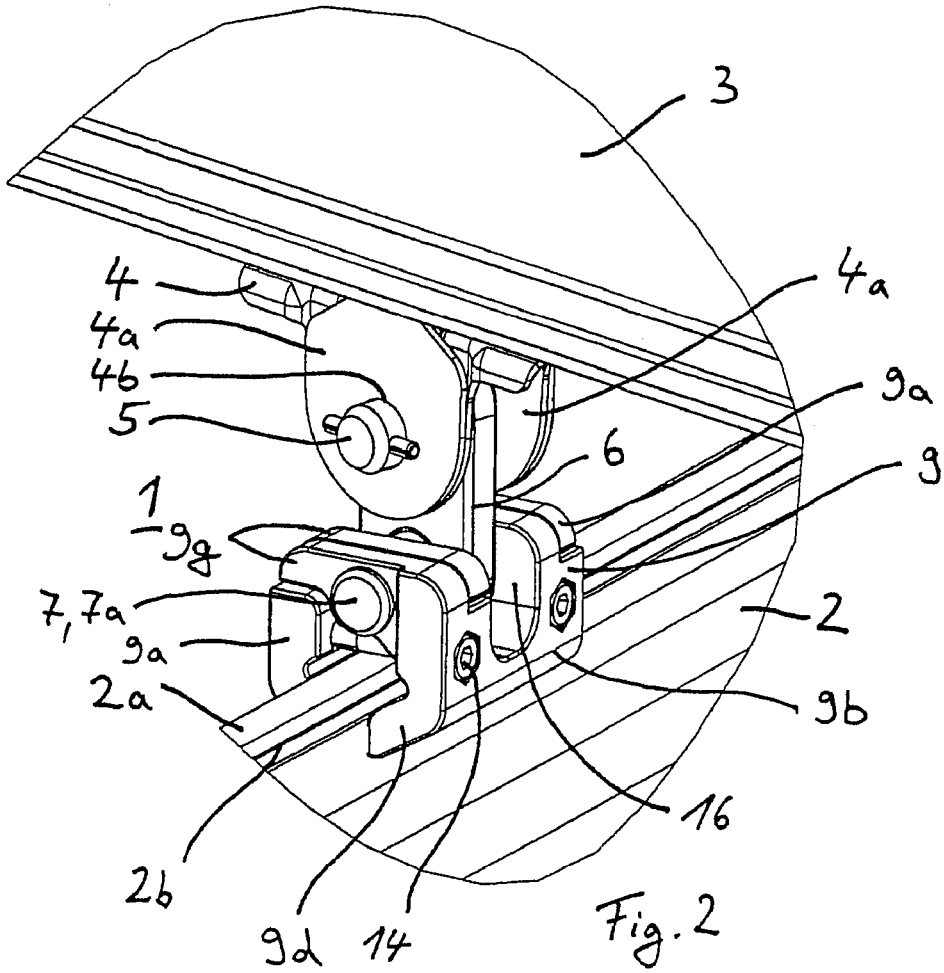
FIG. 2 is a magnified feature of region Z of FIG. 1.

In FIGS. 1 and 2, a single-beam overhead crane is shown with two suspensions 1, by which an essentially horizontal C-shaped rail 2, open at the bottom, is suspended from two essentially horizontal C-shaped travel rails 3, likewise open at the bottom, which are laid in parallel and at a distance from each other. The rail 2 travels essentially transverse to the travel rails 3, and can move along the travel rails 3. The rail 2 is suspended from a traversing gear 4 by the two suspensions 1 (see FIG. 2), which can travel in the travel rail 3 along its lengthwise direction by means of rollers (not shown). A hoisting machine (not shown) is hung from rail 2 in typical fashion, such as a chain or rope block, and the hoisting machine can move with an additional traversing gear along rail 2. Also provided are additional suspensions 1 (not shown) along the travel rails 3, by which these are suspended from supporting structures, other rails, or traversing gears.

These suspensions 1 have pivoting bearings and thus have a pendulum type design, which ensures that rail 2 and travel rails 3 automatically orient themselves and thus come into a state of equilibrium, i.e., there is no significant bending load in the suspension 1, or in particular in the tension element 6 arranged in the suspension (see FIG. 2).

Thus, it is possible to grab the hoisting machine at the load or a suspended switch and move it along the rail 2 and the travel rail 3 without a special drive unit. When moving along the travel rail 3, it often happens due to the flow of force off center—and depending on the particular position of the hoisting machine on the rail—that rail 2 and the hoisting machine will become slanted relative to a position perpendicular to the travel rails 3. This slanted position is around 20 to 30 degrees. Normally, such a slanting would result in a seizing of rail 2 or traversing gears 4 on the travel rail 3. But, as previously mentioned, because the suspensions 1 are of a pendulum type, when travel rails 3 become crooked, their mutual spacing is simply reduced. Traversing gears 4 can continue to travel unhindered in the travel rails 3. Here, pendulum suspension 1 means that a turning about a vertical axis and also a lateral tilting are enabled.

As shown in FIG. 2, traversing gear 4 has two brackets 4*a*, each with a bore 4*b*. The brackets 4*a*, parallel to each other and spaced apart, extend downward from the travel rail 3. Between the brackets 4*a* is arranged an upper end of a tension element 6 of the suspension 1. The tension element 6 is configured as a flat bracket in the manner of a connecting rod or a strip shape and is oriented roughly perpendicular to the lengthwise direction of the rail 2. This tension element 6 has an upper bore 10 and a lower bore 11 (see FIG. 3). The tension element 6 is suspended from the traversing gear by a bolt 5, which is passed through the bore 4*b* of the first bracket 4*a*, the upper bore 10 and the bore 4*b* of the second bracket 4*a*. The upper bore 10 has a knife-edge bearing, i.e., the bore 10 is crowned in configuration and the bolt 5 is guided point-like on the knife edge formed by the convexity with angular mobility. The lower bore 11 serves to suspend the rail 2 from the tension element 6. Another bolt 7 is passed through the lower bore 11, whose ends 7*a*, 7*b* projecting beyond the tension element 6 in the lengthwise direction of the rail 2 engage with a fixing device 9 and are secured there in bores 13, unable to twist. Fixing device 9 encloses with form fitting an upper web 2*a* of the rail 2, which is Y-shaped and broadens correspondingly toward the top, starting from the top side of rail 2. A T-shaped or a different broadening configuration of the web 2*a* is also possible.

Figure 3:
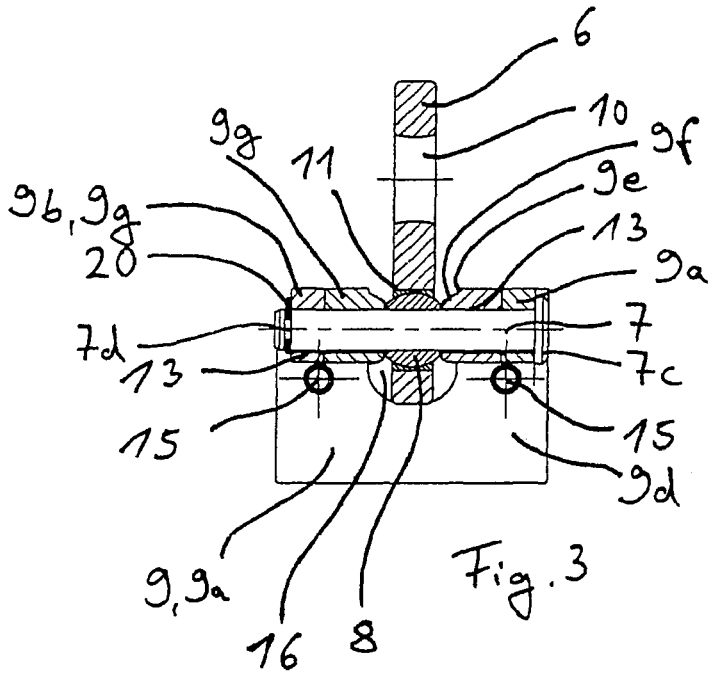
FIG. 3 is a side elevation view of the suspension of FIG. 2.
Figure 4:
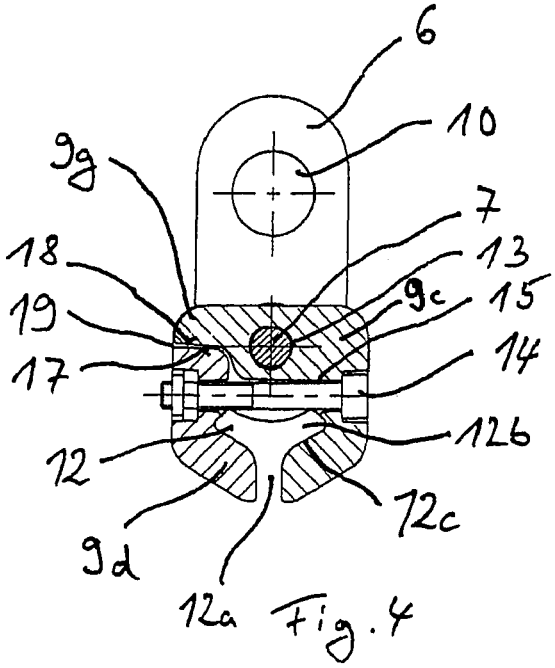
FIG. 4 is a front elevation of FIG. 3, partly sectional, with fixing parts in the fixing position.
Figure 5:
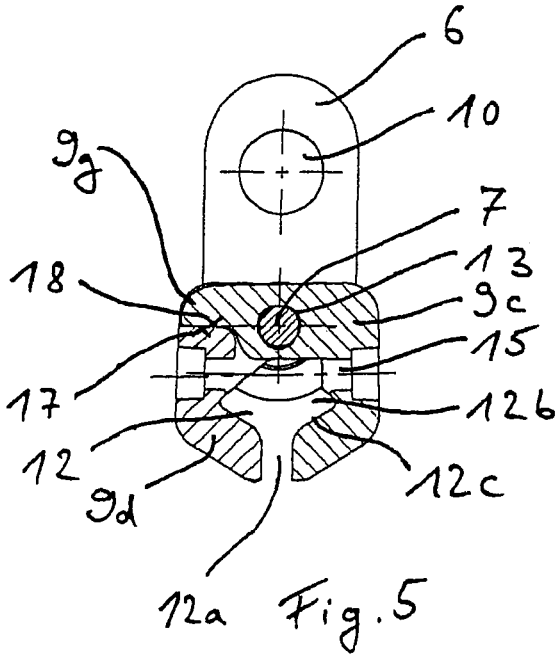
FIG. 5 is a front elevation of FIG. 3 with fixing parts in the open position.

FIGS. 3 to 5 show in detail a first embodiment of the suspension 1 for rail 2, including its fixing device 9, and FIGS. 6 and 7 show suspension 1 in a second embodiment. Supplementing the description given for FIG. 2, a pivoting bearing 8 is arranged in the lower bore 11 of tension element 6, through which bolt 7 passes. Bolt 7 is oriented parallel to the lengthwise direction of the rail 2. Thus, the tension element 6 can swivel sideways to the right and left about the bolt 7, relative to the fixing device 9 and in the lengthwise direction of the rail 2. Tension element 6 can also turn through around ±15°, in the lengthwise direction of tension element 6. An additional ±15° swiveling capability occurs between tension element 6 and bolt 5 at the knife-edge bearing in the bore 10.

FIGS. 3 to 5 show a first embodiment of the fixing device 9, which includes two identical fixing parts 9*a* and 9*b*. The two fixing parts 9*a* and 9*b* are fastened together and are able to swivel from an open position to a fixing position, but are limited by bolt 7 for suspension from the tension element 6. FIG. 4 shows the fixing position, and FIG. 5 shows the open position. In both positions and any intermediate position, the fixing parts 9*a*, 9*b* have a C-shaped cross section open at the bottom, which bounds an upwardly broadening, mushroomshaped lengthwise opening 12, in the lengthwise direction of the rail 2. In terms of function, fixing parts 9*a*, 9*b* can be divided into an upper suspension region 9*c* and a lower fixing region 9*d*. This lengthwise opening 12, which is bounded by the fixing region 9*d* of the fixing parts 9*a*, 9*b* of the fixing device 9, has a lower gap region 12*a* and, above it, an opening region 12*b*. Thus, in the lengthwise direction of rail 2, the fixing region 9*d* has the shape of two opposite fixing arms or gripping arms, spaced apart and bent inward at their lower free end. The gripping arms are bent toward each other, terminating in the gap region 12*a*, thus diminishing the opening region 12*b*. In the opening region 12*b*, the fixing region 9*d* has flat bearing surface 12*c*, slanting upward and starting from the gap region 12*a*. Bearing surfaces 12*c* provide a two-dimensional accommodation of the ends 2*b* of the Y-shaped web 2*a*, broadening outwardly in opposite directions. Thus, bearing surfaces 12*c* take up both the load of rail 2 and the load suspended from or being carried thereon, regardless of whether fixing device 9 is in the open or fixing position.

Fixing parts 9*a*, 9*b* have limited angular mobility around the bolt 7 and form a kind of pincer mechanism to restrain the rail 2. However, a special feature of fixing parts 9*a*, 9*b* is that their angular mobility is limited such that even in the open position, the ends 2*b* of the web 2*a* cannot slip down from the lengthwise opening 12 of the fixing device 9. Thus, ends 2*b* of web 2*a* are firmly restrained.

In the first embodiment, fixing device 9 of suspension 1, including its fixing parts 9*a* and 9*b*, has an intermediate space 16 open at the top, running transversely and horizontally when viewed in the lengthwise direction of the rail 2. Intermediate space 16 is bound by a U-shaped fixing device 9, including its web-like suspension regions 9*c*. On the inner sides 9*e* of suspension regions 9*c* of the fixing device 9, which face each other, flat conical projections 9*f* are arranged. Bores 13 of the suspension regions 9*c* of the fixing device 9 for the bolt 7 are continued centrally in these projections 9*f*. Because of the projections 9*f*, intermediate space 16 is narrowed and resting surfaces are created for the pivoting bearing 8.

Moreover, intermediate space 16 divides the pivoting connection of the two fixing parts 9*a*, 9*b* into a first and a second hinge-like pivot region. Each of these pivot regions has an arm 9*g* of the fixing region 9*d* of the particular fixing part 9*a*, 9*b*. Each of the arms 9*g* receives a portion of the bore 13 for the bolt 7, roughly down the center in the lengthwise direction of the rail 2. The arrangement of arms 9*g*, bolt 7 and bore 13 is comparable to a multiple-section bolt connection.

To accomplish the aforementioned limiting of the angular mobility of the fixing parts 9*a* and 9*b*, bearing surfaces 17 are formed on one fixing part 9*a* and mating surfaces 18 on the other fixing part 9*b*. The mating surfaces 18 are arranged on the lower sides of the free ends of the arms 9*g* and are basically oriented horizontally. Bearing surfaces 17 are situated at the side next to the beginning of the arm 9*g* on the fixing part 9*a*, 9*b*, which is opposite the free end. Thus, they lie opposite each other in relation to the bolt 7.

In the open position of fixing parts 9*a* and 9*b*, bearing surfaces 17 and mating surfaces 18, which are arranged like the clamping jaws of pliers in relation to each other, come to bear against each other. In the fixing position, the bearing surfaces 17 are separated from the mating surfaces 18 by a gap 19. However, the bearing surfaces 17 and the mating surfaces 18 do not prevent a closing movement, i.e., a bearing against the web 2*a* between the gripping levers.

To be able to secure fixing device 9 at a desired position in the lengthwise direction after it is shoved onto the web 2*a* or put together around the web 2*a*, two screws 14 are provided. Screws 14 pass through the fixing parts 9*a*, 9*b* at such a height that they do not interfere with the web 2*a* and that they cross through the opening region 12*b* of the lengthwise opening 12 beneath arms 9*g*. By means of screws 14, fixing parts 9*a*, 9*b* can be moved about the bolt 7 and swiveled from the open position to the fixing position against each other, until the ends of the gripping arm regions 9*d* come to bear against the web 2*a*. It should be stressed once more that this clamping serves mainly to secure the fixing device 9 in the lengthwise direction of the rail 2 and has basically no fixing or supporting function.

Accordingly, the size and the height of opening region 12*b* of the lengthwise opening 12 is configured such that screws 14 have sufficient room to cross the lengthwise opening 12 beneath bolt 7 and above web 2*a*. However, the height of the lengthwise opening 12 is not enough to shove fixing device 9 in the assembled condition from one end of rail 2 onto its web 2*a* in the lengthwise direction of the rail 2, which runs essentially horizontally. Such a movement is prevented because cylindrical connection sleeves 2*c* are arranged on web 2*a* in the upper opening of the web 2*a*, at the start and end of rail 2. Connection sleeves 2*c* serve to join the abutted ends of two rails 2. Additional connection sleeves 2*c* are located at the C-shaped lower ends of rail 2 (see FIG. 1). Connection sleeves 2*c*, which lie opposite each other at the end of two rails 2, can then easily be joined by screws to align rails 2 with each other.

Thus, fixing device 9 must be assembled at the desired suspension point on the rail 2. Two fixing parts 9*a*, 9*b* are joined together without bolt 7 and screws 14 at the desired suspension point on rail 2 so that bores 13 are aligned and the web 2*a* of rail 2 is grasped by the fixing regions 9*d* of the fixing device 9. Then, bolt 7 is inserted into bore 13 from one side, in the lengthwise direction of rail 2, so that it passes through the part of bore 13 of the first two arms 9*g* of the fixing parts 9*a*, 9*b*. Tension element 6, including pivoting bearing 8, is then inserted into the intermediate space 16 and lined up with bore 13. Bolt 7 is shoved further through pivoting bearing 8, and the remainder of bore 13 into the two second arms 9*g* of the fixing parts 9*a*, 9*b* until the head 7*c* of bolt 7 comes to rest against fixing device 9. At the other side, the other end 7*a* of bolt 7 sticks out from bore 13. To secure bolt 7 in bore 13, a circumferential groove 7*d* is provided at the end 7*a* of the bolt 7 that is sticking out, into which a snap ring 20 is inserted from the side and comes to bear against the other end of fixing device 9.

In an alternative embodiment of fixing device 9 (not shown), the height of opening region 12*b* and the size of gap region 12*a* in the open position, or the spacing of the arm-like fixing regions 9*d*, are configured such that the fixing device 9 can be shoved onto the web 2*a* of the rail 2 from one end in the lengthwise direction of the rail 2, which runs essentially horizontally. The lengthwise opening 12, especially its opening region 12*b*, starting from the gap region 12*a*, is then provided with a sufficient height to allow the web 2*a*, as well as the connection sleeves 2*c*, to pass.

In the above-described sample embodiments, tension element 6 is connected to fixing device 9 by means of a pivoting bearing 8. It is also possible to fasten tension element 6 by its lower bore 11 directly to fixing device 9 by means of bolt 7. A knife-edge bearing can be provided in the bore 11, as described above.

Also, the aforementioned sample embodiment describes the preferred use of suspension 1 with single-beam overhead cranes, namely, between rail 2 and travel rail 3. This new suspension 1 is also suitable for suspending the travel rails 3 from suitable support structures or other rails 2. Rail 2 may also be I-shaped.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A combination travel rail and device for suspending the travel rail of one of an overhead conveyor and a hoisting machine, from one of a traversing gear and a supporting structure, said combination comprising:

a travel rail having a support element that widens and extends at least partly in a lengthwise direction of the rail;

a tension element for carrying the rail by one end;

a fixing device for grasping the support element of the rail;

wherein the fixing device includes first and second fixing parts connected by a bolt running in the lengthwise direction of the rail, said first and second fixing parts having fixing regions that swivel from an open position to a fixing position, wherein at least one of said first and second fixing parts includes at least one bearing surface for resting the support element of the rail; and wherein an other bearing surface is arranged on said first fixing part and a mating surface is arranged on said second fixing part, wherein said other bearing surface and said mating surface bear against each other when the fixing device is in the open position to limit the movement of said first and second fixing parts in the direction of opening.

2. The device per claim 1, further comprising a fastening means for frictionally fastening the fixing device on the support element in the lengthwise direction of the rail in the fixing position.

3. The device per claim 2, wherein the fixing device is configured to be shoved onto the support element in the lengthwise direction of the rail in the open position.

4. The device per claim 3, wherein the fixing device is configured to engage the support element of the rail with the support element configured as one of a Y-shaped and a T-shaped web in the lengthwise direction of the rail and arranged on top of the rail.

5. The device per claim 4, wherein a lengthwise opening is arranged in the fixing device in the lengthwise direction of the rail, wherein the lengthwise opening narrows to a gap region in the direction of the rail, said gap region being narrower than a widening region of the support element of the rail, wherein the fixing device is configured to hold the support element in the lengthwise opening.

6. The device per claim 5, wherein the fixing device includes the at least one bearing surface in the region of the lengthwise opening.

7. The device per claim 6, wherein the fixing parts of the fixing device are held in the fixing position by a fastening means in the form of screws, wherein the fixing regions of the fixing parts are configured to be pretensioned against the sides of the support element in the lengthwise direction of the rail in the fixing position.

8. The device per claim 1, wherein said first and second fixing parts are substantially identical.

9. A combination travel rail and device for suspending the travel rail of one of an overhead conveyor and a hoisting machine, from one of a traversing gear and a supporting structure, said combination comprising:

a travel rail having a support element configured as one of a Y-shaped and a T-shaped web having a widening region that extends at least partly in the lengthwise direction of the rail and is arranged on top of the rail;

a tension element for carrying the rail by one end;

a fixing device for grasping the support element of the rail, the fixing device including first and second fixing parts connected by a bolt running in the lengthwise direction of the rail, said first and second fixing parts having fixing regions that swivel from an open position to a fixing position, wherein at least one of said first and second fixing parts includes at least one bearing surface for resting the support element of the rail;

the fixing device having a lengthwise opening that is arranged in the lengthwise direction of the rail, with the at least one bearing surface in the region of the lengthwise opening, wherein the lengthwise opening narrows to a gap region in the direction of the rail, the gap region being narrower than the widening region of the support element of the rail for holding the support element of the rail at the lengthwise opening;

wherein the fixing parts of the fixing device are held in the fixing position by a fastening means in the form of screws, wherein the fixing regions of the fixing parts are configured to be pretensioned against the sides of the support element in the lengthwise direction of the rail in the fixing position;

wherein the fixing device is configured to be shoved onto the support element in the lengthwise direction of the rail with the fixing device in the open position; and wherein an other bearing surface is arranged on said first fixing part and a mating surface is arranged on said second fixing part, wherein said other bearing surface of said first fixing part and said mating surface of said second fixing part bear against each other when the fixing device is in the open position to limit the movement of said first and second fixing parts in the direction of opening.

10. The device per claim 9, wherein an other bearing surface is arranged on said second fixing part and a mating surface is arranged on said first fixing part, and wherein said other bearing surface of said second fixing part and said mating surface of said first fixing part bear against each other when the fixing device is in the open position to limit the movement of said first and second fixing parts in the direction of opening.

11. The device per claim 10, wherein said first and second fixing parts are substantially identical.

12. The device per claim 1, wherein the fixing device is configured to engage the support element of the rail with the support element configured as one of a Y-shaped and a T-shaped web in the lengthwise direction of the rail and arranged on top of the rail.

13. The device per claim 1, wherein a lengthwise opening is arranged in the fixing device in the lengthwise direction of the rail, wherein the lengthwise opening narrows to a gap region in the direction of the rail, said gap region being narrower than a widening region of the support element of the rail, wherein the fixing device is configured to hold the support element in the lengthwise opening.

14. The device per claim 1, wherein the fixing device includes the at least one bearing surface in the region of the lengthwise opening.

* * * * *